US007051814B2

(12) United States Patent
Goode et al.

(10) Patent No.: US 7,051,814 B2
(45) **Date of Patent: *May 30, 2006**

(54) SUBSEA COILED TUBING INJECTOR WITH PRESSURE COMPENSATED ROLLER ASSEMBLY

(75) Inventors: John Goode, Arlington, TX (US); Ivan Iankov, Houston, TX (US); Ronald Yater, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 170 days.

This patent is subject to a terminal disclaimer.

(21) Appl. No.: 10/705,329

(22) Filed: Nov. 10, 2003

(65) Prior Publication Data

US 2004/0094306 A1 May 20, 2004

Related U.S. Application Data

(60) Provisional application No. 60/425,399, filed on Nov. 12, 2002.

(51) Int. Cl.
*E21B 19/22* (2006.01)

(52) U.S. Cl. ..... 166/339; 166/384; 166/385; 166/77.3

(58) Field of Classification Search ..... 166/384, 166/385, 77.2, 77.3, 242.2, 339; 226/194; 384/131

See application file for complete search history.

(56) References Cited

U.S. PATENT DOCUMENTS

| | | | | |
|---|---|---|---|---|
| 3,176,996 | A * | 4/1965 | Barnett | 277/318 |
| 4,335,791 | A * | 6/1982 | Evans | 175/228 |
| 4,899,823 | A | 2/1990 | Cobb et al. | |
| 5,778,981 | A | 7/1998 | Head | |
| 5,890,534 | A | 4/1999 | Burge et al. | 166/77.3 |
| 6,006,839 | A | 12/1999 | Dearing et al. | |
| 6,042,303 | A | 3/2000 | Head | |
| 6,102,125 | A | 8/2000 | Calder | |
| 6,116,345 | A | 9/2000 | Fontana et al. | |
| 6,763,889 | B1 | 7/2004 | Rytlewski et al. | 166/338 |
| 6,834,724 | B1 | 12/2004 | Headworth | |
| 2003/0178200 | A1 * | 9/2003 | Fox et al. | 166/341 |

FOREIGN PATENT DOCUMENTS

GB 2058244 A * 4/1981

* cited by examiner

*Primary Examiner*—Kenneth Thompson
(74) *Attorney, Agent, or Firm*—Guy McClung

(57) ABSTRACT

A tubing injector (10) includes a traction device (12) having opposed grippers (14) laterally moveable so as to move a respective chain link member (16) of an endless loop chain into gripping engagement with the coiled tubing. A drive motor (11) is provided for powering the endless loop chain, and a plurality of roller bearings (20) each act between a respective chain link member and a gripper. A pressure compensating device (30) subjects fluid in a fluid passageway in the roller bearing (20) to a fluid pressure functionally related to subsea pressure. The tubing injector may be used for injecting the coiled tubing subsea into a wellhead or into another flowline.

20 Claims, 9 Drawing Sheets

SUBSEA COILED TUBING INJECTOR WITH PRESSURE COMPENSATED ROLLER ASSEMBLY

RELATED CASES

This application claims priority from U.S. Ser. No. 60/425,399 filed Nov. 12, 2002.

FIELD OF THE INVENTION

The present invention relates to a subsea coiled tubing injector and, more particularly, to a subsea coiled tubing injector capable of achieving reliable operation at a relatively low cost.

BACKGROUND OF THE INVENTION

Coiled tubing has been reliably used in land-based hydrocarbon recovery operations for decades, since various well treatment, stimulation, injection, and recovery operations may be more efficiently performed with conveyed coiled tubing than with threadably connected joints of tubulars. A conventional coiled tubing injector may be positioned at the surface of a land-based well or in relatively shallow water of an offshore well, although positioning a conventional tubing injector in a moderate or deep water well is impractical for most offshore coiled tubing operations.

Some injectors have utilized sealed bearings for both land and shallow water operations. Conventional dynamic seals in sealed bearing packages cannot, however, reliably withstand the hydrostatic sea pressure and high operating speeds encountered for a coiled tubing injector working in a deep water environment.

According to one proposal, the subsea tubing injector is protected from the subsea environment by an enclosure, with seals provided between the enclosure and the coiled tubing above and below the injector. An example of this system is discussed in U.S. Pat. No. 4,899,823.

The disadvantages of the prior art are overcome by the present invention, and an improved subsea coiled tubing injector and method of injecting coiled tubing subsea are hereinafter provided.

SUMMARY OF THE INVENTION

A tubing injector for injecting coiled tubing into a subsea well or other flowline includes a traction device with opposed grippers laterally moveable with respect to the coiled tubing move a respective chain link member of an endless loop chain into gripping engagement with the coiled tubing. A plurality of roller bearings are provided each acting between a respective chain link member and a gripper, with each roller bearing including a shaft and seals subjected to subsea conditions. A pressure compensating device is provided for subjecting fluid, such as a lubricant, in a fluid passageway in the roller bearing to a fluid pressure functionally related to the subsea pressure, such that a controlled pressure differential exists across the seals which seal the fluid from the subsea conditions.

In one embodiment, the pressure compensating device includes a piston moveable within a bore in the shaft of the roller bearing, while in another embodiment the pressure compensating device includes a diaphragm within the shaft for sealing lubricant from the subsea conditions. A biasing member may be provided for exerting a selected bias on the piston or on the diaphram. A fluid inlet port may be provided in the shaft for selectively inputting fluid into the fluid passageway in the roller bearing assembly, and a check valve prevents the fluid from passing outward from the fluid passageway.

According to the method of the invention, the fluid in the passageway in the roller bearing is automatically pressure compensated to a fluid pressure functionally related to the subsea pressure, such that a controlled pressure differential exist across the seals which seal the fluid from the subsea conditions.

It is a feature of the invention that the tubing injector may be reliably used subsea in relatively deep water due to the pressure compensation of the roller bearing assembly.

An advantage of the invention is that the pressure compensation technique is highly reliable and relatively inexpensive.

These and further features and advantages of the present invention will become apparent from the following detailed description, wherein reference is made to the figures in the drawings.

DETAILED DESCRIPTION OF PREFERRED EMBODIMENTS

Figure 1:
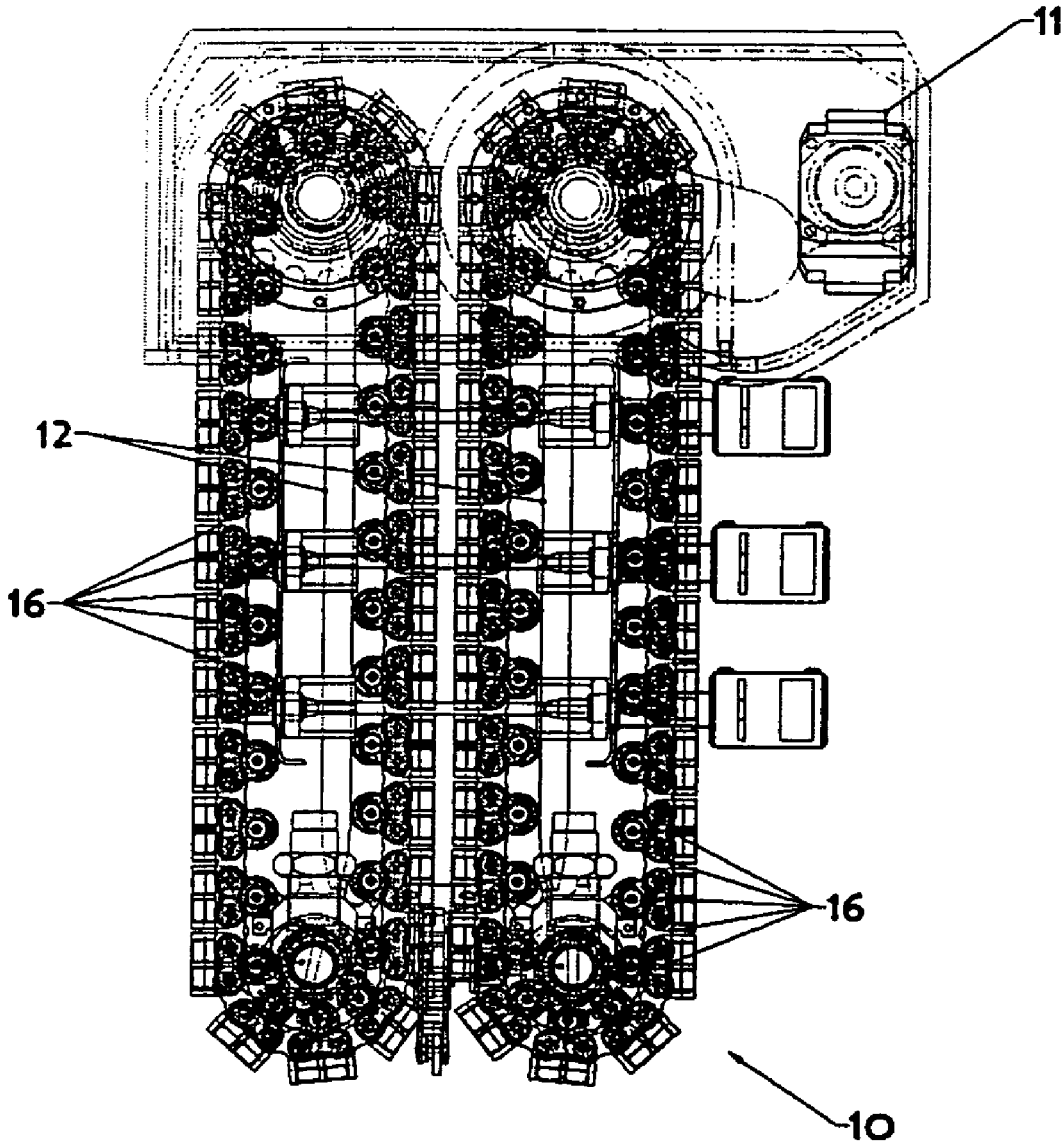
FIG. 1 is a cross sectional view of a conveyed coiled tubing injector according to the present invention, with two opposing chains.
Figure 2:
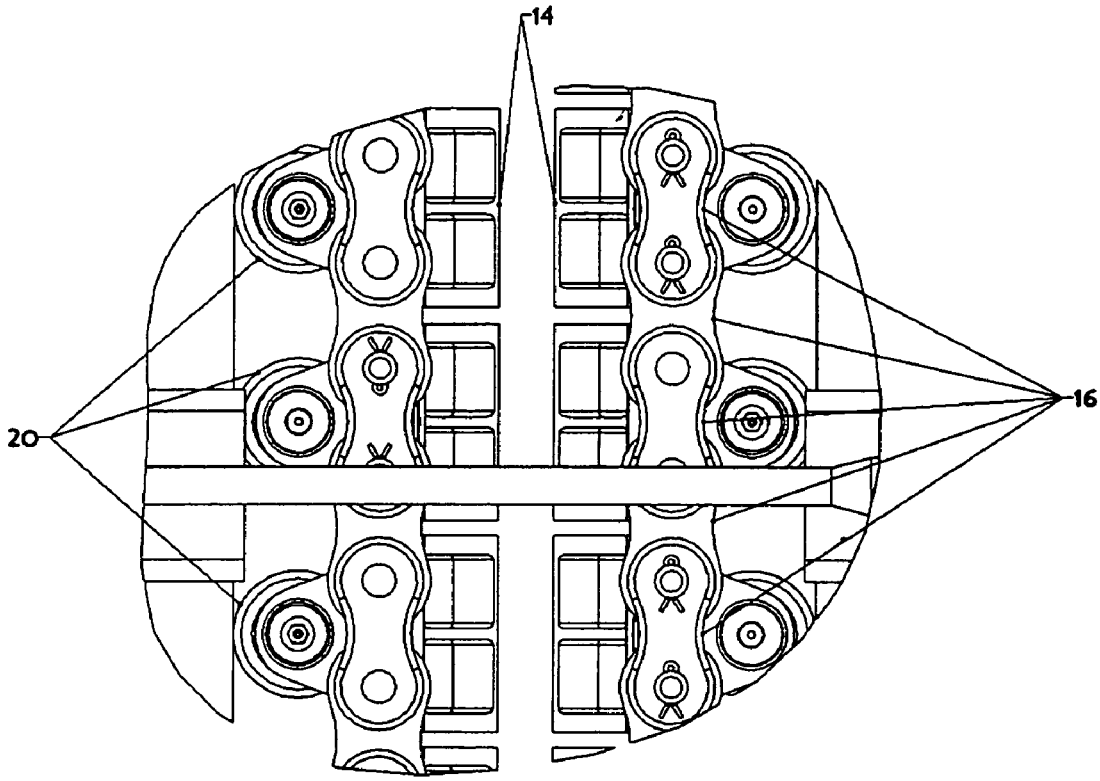
FIG. 2 is an enlarged view of a portion of the injector shown in FIG. 1.

An exemplary coiled tubing injector 10 according to the invention utilizes a traction assembly 12 as shown in FIG. 1 to engage the coiled tubing and thereby drive the coiled tubing into or out of the well. A typical traction device comprises opposing grippers 14 (see FIG. 2) that move laterally with respect to the tubular, thereby pressing the chain link members 16 moving in an endless loop into gripping engagement with the tubing. Each chain link member 16 thus moves longitudinally with respect to the stationary grippers 14 to move the tubing with respect to the tubing injector.

Figure 3:
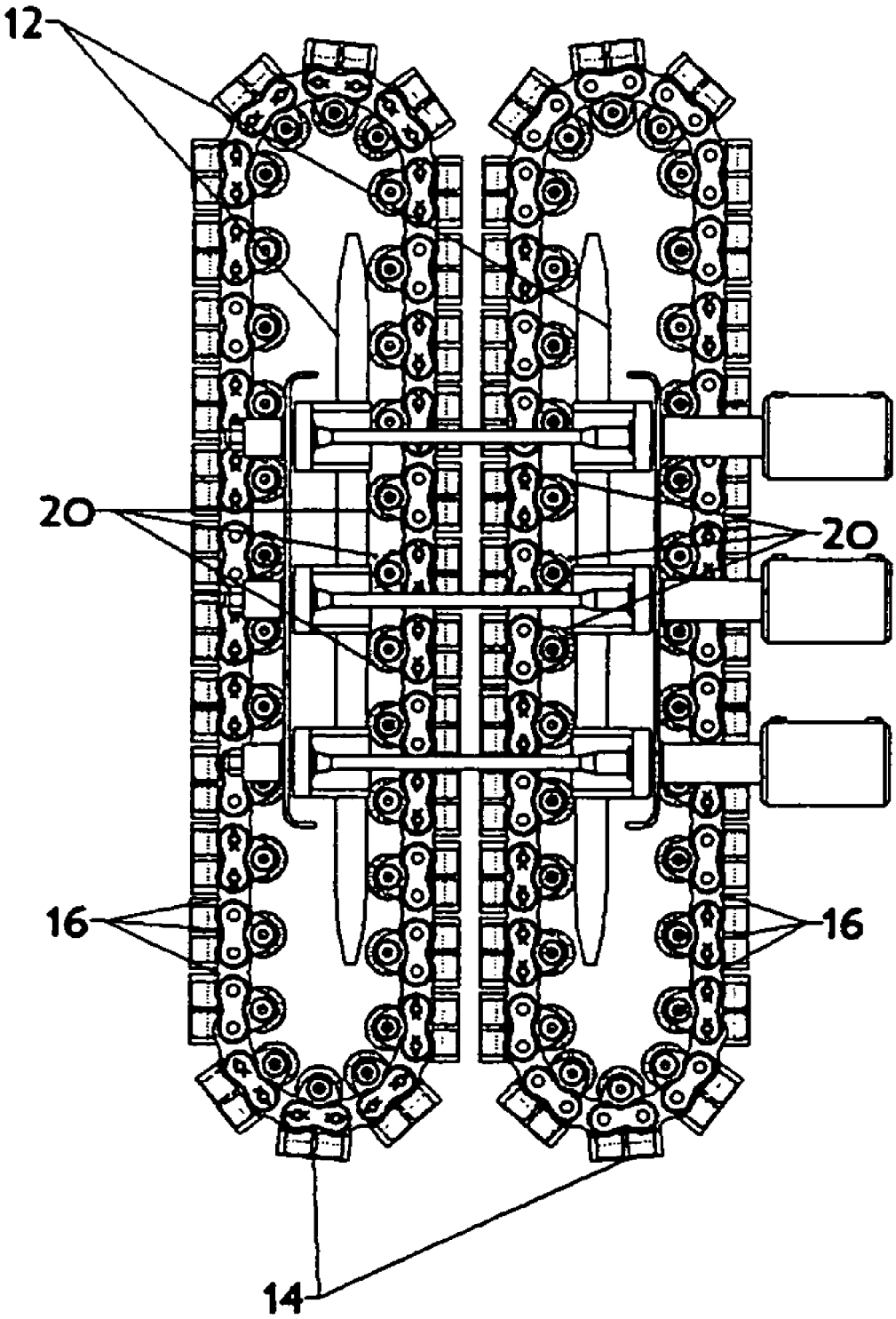
FIG. 3 depicts rollers attached to chain link segments, so that the rollers ride on the base of the gripper.
Figure 4:
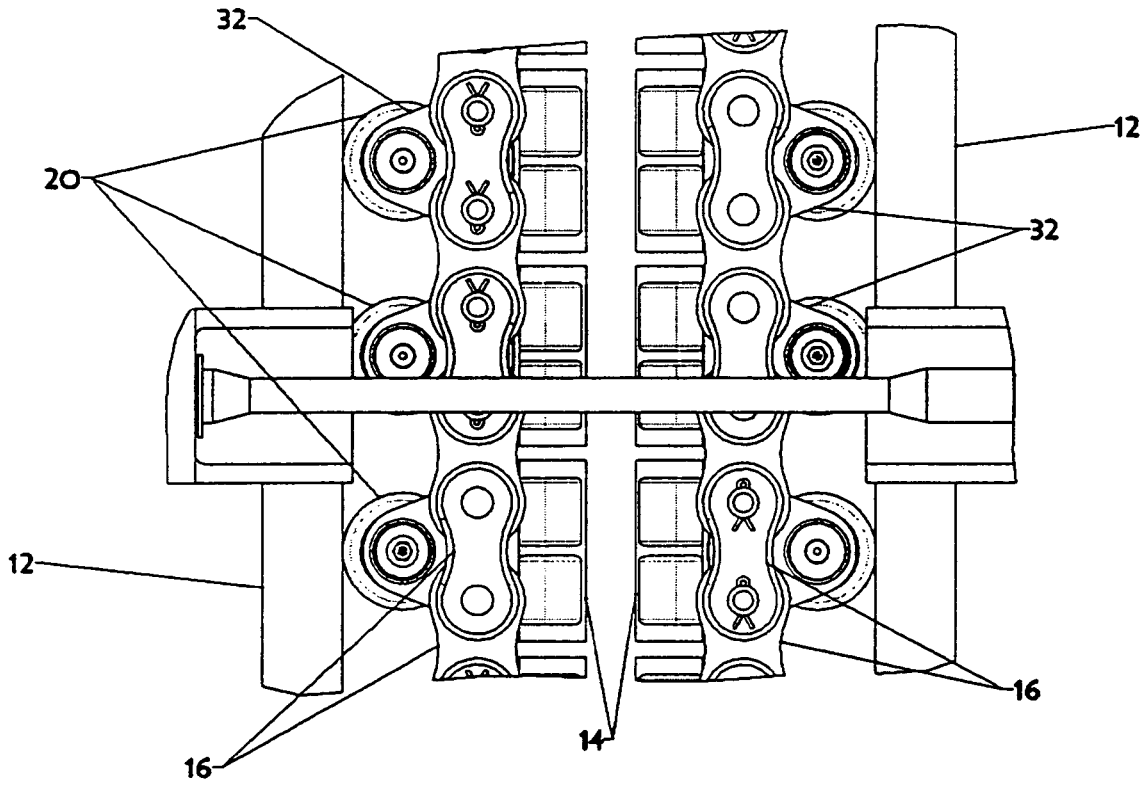
FIG. 4 is an enlarged portion of the assembly shown in FIG. 3.
Figure 5:
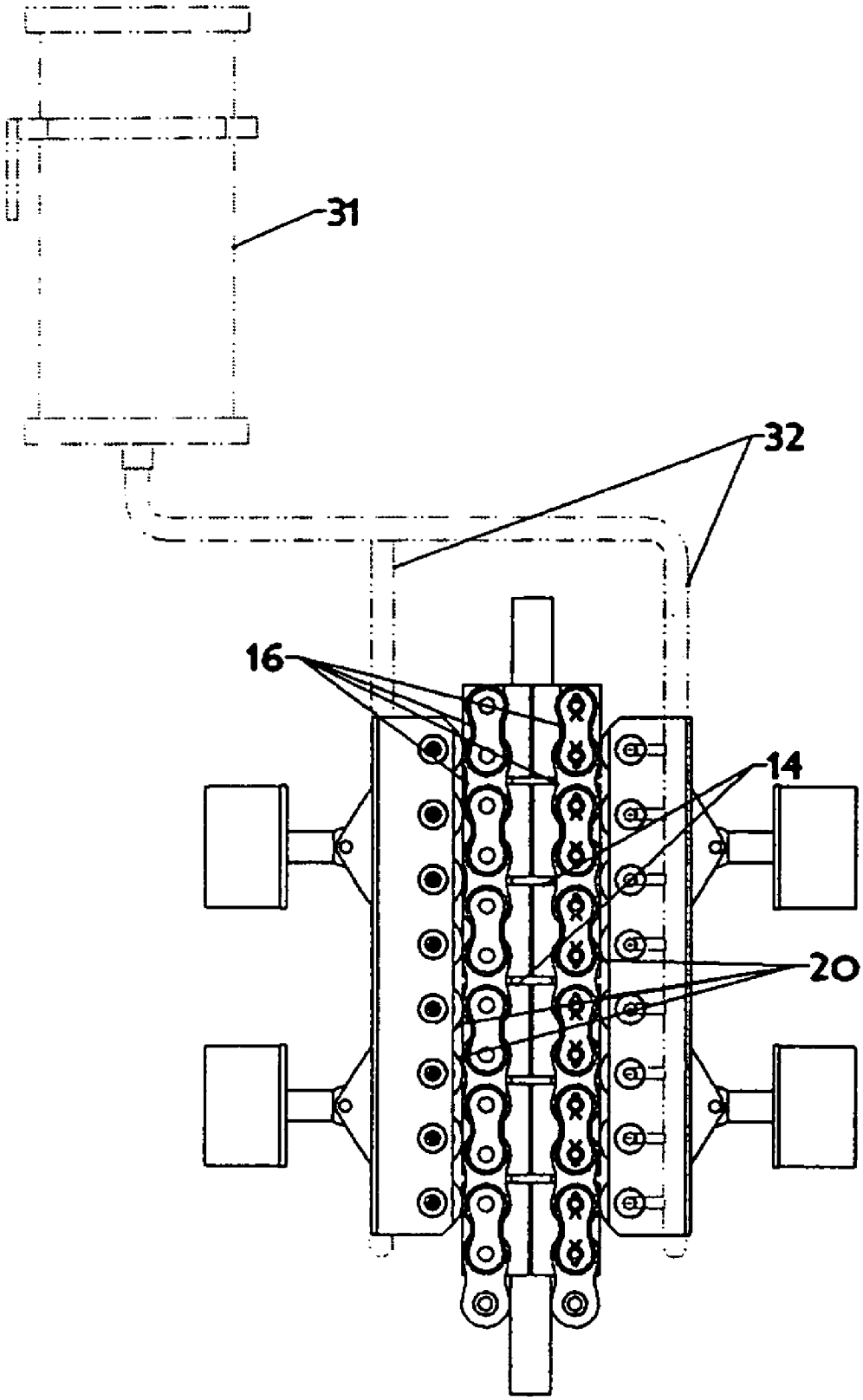
FIG. 5 illustrates rollers mounted on the carrier of opposing gripper blocks, so that the chain link members move relative to the rollers.

Roller bearings 20 provided on the chain link members 16 allow for a large lateral load to be applied from the grippers to the longitudinally moving chain links, preferably without inducing a significant longitudinal drag load. For the embodiment as shown in FIG. 3, the rollers 20 shown in greater detail in FIG. 4 are attached to the chain link segments 16 and thus ride on the base or skate of the grippers 14. For the design as shown in FIG. 5, the rollers 20 may be located in a carrier supported on the gripper blocks, so that the chain link members 16 move relative to the rollers 20. The fluid powered or electrically powered drive motor 11 rotates the links of each endless loop chain.

Figure 6:
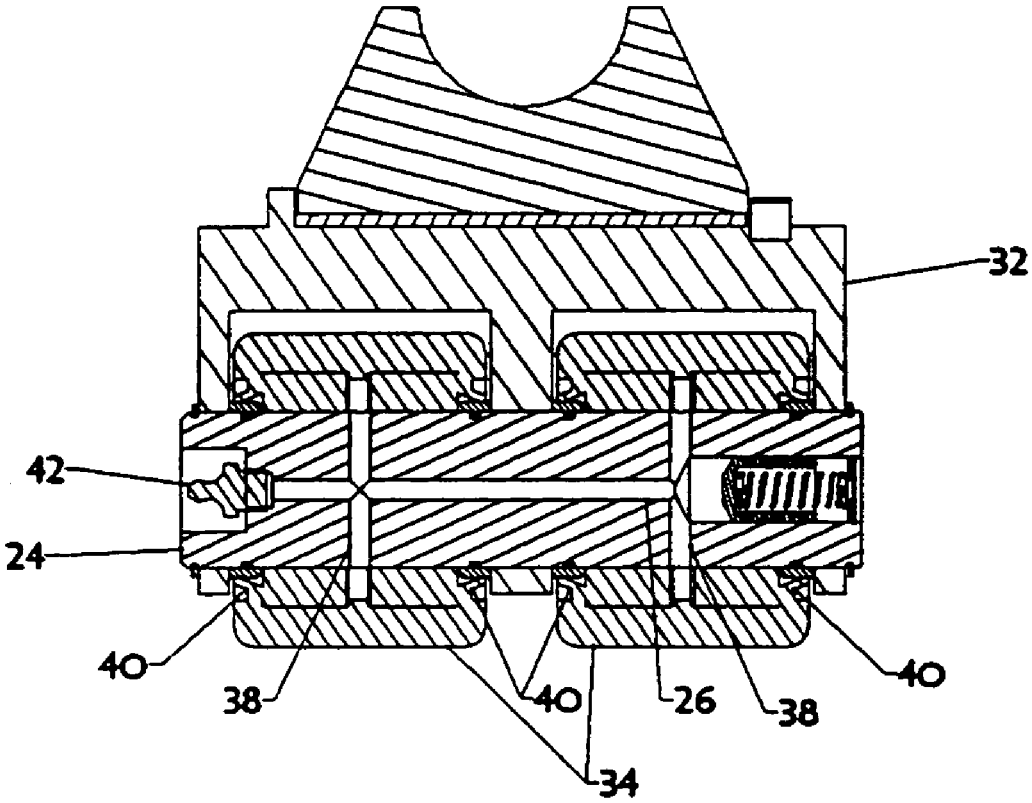
FIG. 6 illustrates a cross-section a roller or bearing with a pressure compensating device located within the shaft of the bearing.

According to the present invention, differential pressure on the roller bearings 20 in the traction assembly 12 of a tubing injector 10 used in a subsea operation is reliably controlled to a desired low level. For the design as shown in FIG. 1, a pressure compensating device 30 as shown in greater detail in FIG. 7 may be mounted in each bearing shaft 24, as shown in FIG. 6, and a lubricant provided to the bearing via a lube passage 26. The frame 32 of the bearing assembly may thus be secured to one of the chain link segments 16, and preferably a pair of rollers 34 are provided on shaft 24. Fluid passageways 26, 38 thus provide lubricant to the bearings, with the seals 40 sealing between the subsea conditions and the fluid within the lubricant passageways. A check valve, such as a lubricant zirc 42, may be mounted on the shaft 24 for filling the passageways 26, 38 with lubricant, and closing to seal lubricant from the surrounding environment.

Figure 7:
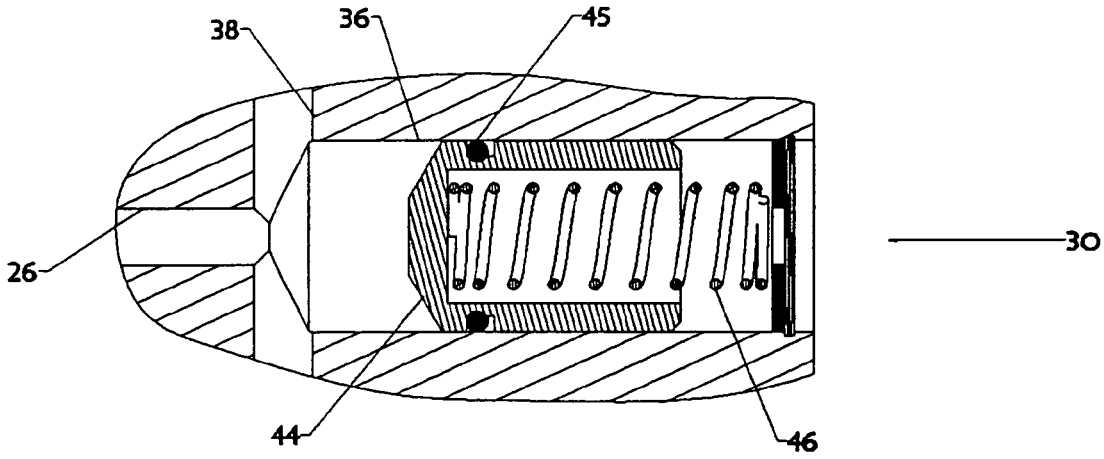
FIG. 7 illustrates in greater detail a portion of the roller shown in FIG. 6.
Figure 8:
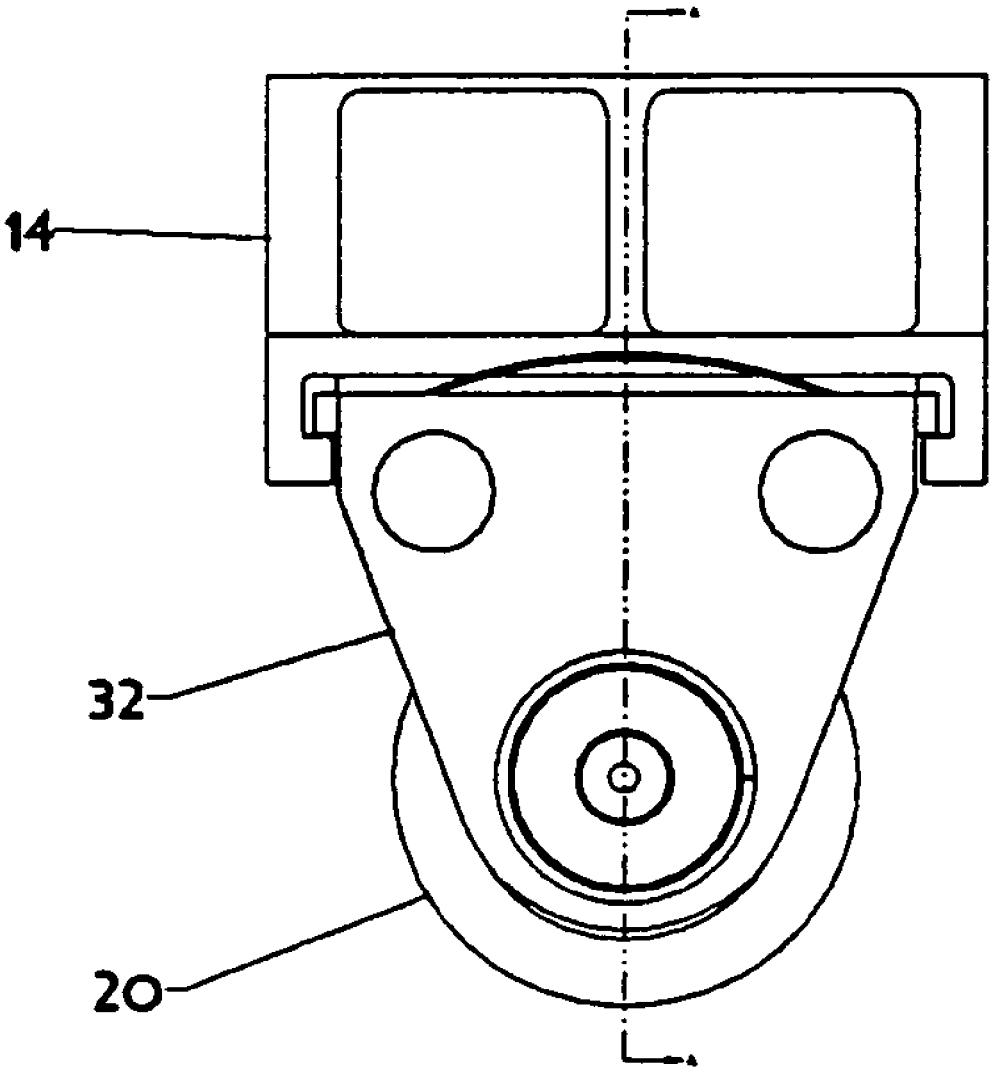
FIG. 8 is a side view of the roller shown in FIG. 6.
Figure 9:
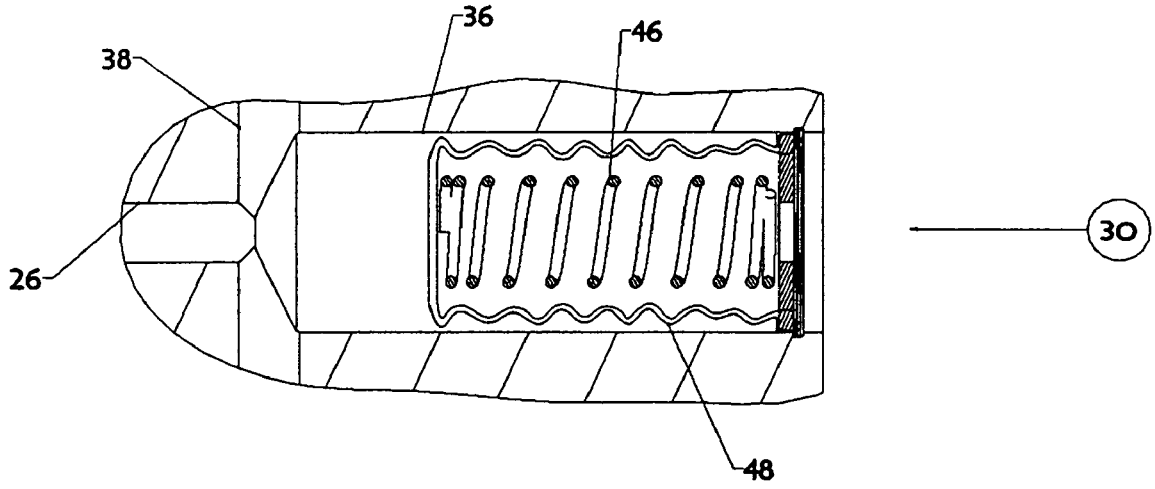
FIG. 9 illustrates a portion of a shaft with a diaphragm separating the lubricant passageways from the subsea environment.

FIG. 7 illustrates the pressure compensating device 30 shown as a piston 44 which moves within a cylindrical bore 36 provided in the shaft 24. The piston thus has one face exposed to lubricant pressure in the fluid passageways 26, while the opposed side of the piston is exposed to the subsea environment. A seal 45 preferably seals between the piston and the shaft. FIG. 7 also illustrates a biasing member, such as coiled spring 46, which may operate to provide a selected bias on the differential between pressure in the lubricant passageways and the subsea environment. In an alternate embodiment as shown in FIG. 9, a diaphragm 48 is provided in the cylindrical bore 36, with one side of the diaphragm assembly exposed to the lubricant and the other side exposed to the subsea environment. A selected bias, such as spring 46, may be provided in the diaphragm assembly.

Since the bearings are sealed either directly or indirectly to the shaft, the differential pressure on the lubricant in the interior of the roller assembly may be controlled to be higher than, equal to, or lower than the pressure of the sea water the exterior of the seal.

For a coiled tubing injector with cam roller bearings mounted on support bars behind the traction chain as shown in FIG. 5, the pressure compensating device may be configured to cooperate with the roller shaft of the bearing, as discussed above. A significant advantage of the coiled tubing injector according to the present invention is that pressure compensation to each bearing may be easily provided with a pressure compensation device in the shaft of the bearing. Alternatively, a remotely positioned subsea pressure compensation device 31 as shown in dashed lines in FIG. 5 may be connected to each roller bearing shaft by a tubing or hose 32 to accomplish pressure balancing.

The pressure compensating device of the present invention is able to control the pressure differential across the seals for various types of fluids provided in the fluid passageway in the roller bearing assembly of a coiled tubing injector. In most applications, the selected fluid would be a lubricant to reduce friction and maintain long life for the roller bearing assembly.

The tubing injector according to the present invention may be used in various applications for injecting coiled tubing subsea. The coiled tubing injector may thus be used for injecting coiled tubing into a subsea well having casing extending downward into the well from a subsea wellhead. In other applications, the coiled tubing injector may be used to inject the coiled tubing subsea into other types of subsea flowlines, including flowlines extending to or from a well.

From the foregoing detailed description of specific embodiments of the invention, it should be apparent that an improved subsea coiled tubing injector and methods have been disclosed. Although specific embodiments of the invention have been disclosed herein some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested in the present disclosure, may be made to the disclosed embodiments without departing from the spirit and scope of the invention as defined by the appended claims which follow.

What is claimed is:

1. A tubing injector for injecting coiled tubing into a subsea flowline, comprising: a traction device including opposed grippers laterally moveable with respect to the coiled tubing to move a respective chain link member of an endless loop chain into gripping engagement with the coiled tubing; a drive motor for powering the endless loop chain; a plurality of roller bearings each acting between a respective chain link member and a gripper, each roller bearing including a shaft and seals subjected to subsea conditions; and a pressure compensating device for subjecting fluid in a fluid passageway in the roller bearing to a fluid pressure functionally related to subsea pressure, such that a controlled pressure differential exists across the seals which seal the fluid from the subsea conditions.

2. A tubing injector as defined in claim 1, wherein the pressure compensating device includes a piston moveable within a bore in the shaft of the roller bearing, with one face of the piston exposed to lubricant and an opposing face of the piston exposed to subsea conditions.

3. A tubing injector as defined in claim 2, further comprising: a seal for maintaining substantially sealed engagement between the piston and the shaft to fluidly isolate the fluid from the subsea conditions.

4. A tubing injector as defined in claim 2, further comprising: a biasing member within the shaft for exerting a selected bias on the piston.

5. A tubing injector as defined in claim 1, wherein the pressure compensating device includes a diaphragm positioned within the shaft for sealing fluid from subsea conditions, such that movement of the diaphragm provides pressure compensation to the fluid.

6. A tubing injector as defined in claim 1, further comprising: a fluid inlet port in the shaft for selectively inputting fluid into the fluid passageway in the roller bearing assembly; and a check valve from preventing the fluid from passing outward from the fluid passageway.

7. A tubing injector for injecting coiled tubing into a subsea flowline, comprising: a traction device including opposed grippers laterally moveable with respect to the coiled tubing to move a respective chain link member of an endless loop chain into gripping engagement with the coiled tubing; a drive motor for powering the endless loop chain; a plurality of roller bearings each acting between a respective chain link member and a gripper, each roller bearing including a shaft and seals subjected to subsea conditions; a fluid inlet port in the shaft for inputting fluid into a fluid passageway in the roller bearing assembly; and a pressure compensating device for subjecting fluid in the fluid passageway in the roller bearing to a fluid pressure functionally related to subsea pressure, such that a controlled pressure differential exists across the seals which seal the fluid from the subsea conditions.

8. A tubing injector as defined in claim 7, wherein the pressure compensating device includes a piston moveable within a bore in the shaft of the roller bearing, with one face of the piston exposed to lubricant and an opposing face of the piston exposed to subsea conditions.

9. A tubing injector as defined in claim 8, further comprising: a seal for maintaining substantially sealed engagement between the piston and the shaft to fluidly isolate the fluid from the subsea conditions.

10. A tubing injector as defined in claim 8, further comprising: a biasing member within the shaft for exerting a selected bias on the piston.

11. A tubing injector as defined in claim 8, wherein the pressure compensating device includes a diaphragm positioned within the shaft for sealing fluid from subsea conditions, such that movement of the diaphragm provides pressure compensation to the fluid.

12. A tubing injector as defined in claim 1, further comprising: a check valve from preventing the fluid from passing outward from the fluid passageway.

13. A tubing injector as defined in claim 1, wherein the tubing injector injects coiled tubing into a subsea well.

14. A method of injecting coiled tubing into a subsea flowline, comprising: providing a traction device including opposed grippers laterally moveable with respect to the coiled tubing to move a respective chain link member of an endless loop chain into gripping engagement with the coiled tubing while powering the endless loop chain; providing a plurality of roller bearings each acting between a respective chain link member and a gripper, each roller bearing including a shaft and seals subjected to subsea conditions; and automatically pressure compensating fluid in a fluid passageway in the roller bearing to a fluid pressure functionally related to subsea pressure, such that a controlled pressure differential exists across the seals which seal the fluid from the subsea conditions.

15. A method injector as defined in claim 14, further comprising: providing a piston moveable within a bore in the shaft of the roller bearing, with one face of the piston exposed to lubricant and an opposing face of the piston exposed to subsea conditions.

16. A method as defined in claim 15, further comprising: maintaining substantially sealed engagement between the piston and the shaft to fluidly isolate the fluid from the subsea conditions.

17. A method as defined in claim 15, further comprising: exerting a selected bias on the piston.

18. A method as defined in claim 14, further comprising: providing a diaphragm positioned within the shaft for sealing fluid from subsea conditions, such that movement of the diaphragm provides pressure compensation to the fluid.

19. A method as defined in claim 14, further comprising: selectively inputting fluid into the fluid passageway in the roller bearing assembly; and preventing the fluid from passing outward from the fluid passageway with a check valve.

20. A method as defined in claim 14, wherein the coiled tubing is injected into a subsea well.

* * * * *